United States Patent [19]

Grikis et al.

[11] 4,389,012

[45] Jun. 21, 1983

[54] FASTENER TOOL LOADING ASSEMBLY

[75] Inventors: Raimonds Grikis, Morton Grove; Bernard W. Geist, Melrose Park; Edmund Frank, Chicago, all of Ill.

[73] Assignee: Duo-Fast Corporation, Franklin Park, Ill.

[21] Appl. No.: 256,491

[22] Filed: Apr. 22, 1981

[51] Int. Cl.[3] ..... B25C 3/00; B25C 1/04

[52] U.S. Cl. ..... 227/120; 221/198; 227/113; 227/156

[58] Field of Search ..... 221/197, 198; 227/120, 227/125, 113, 116, 130, 156

[56] References Cited

U.S. PATENT DOCUMENTS

| | | | |
|---|---|---|---|
| 3,170,596 | 2/1965 | Nyberg | 221/197 X |
| 3,907,099 | 9/1975 | Smith | 198/220 BC |
| 4,323,184 | 4/1982 | Maurer | 227/120 |

*Primary Examiner*—Paul A. Bell

*Attorney, Agent, or Firm*—Mason, Kolehmainen, Rathburn & Wyss

[57] ABSTRACT

An assembly for loading a tool for driving uncollated nails. The tool includes a body with a driver blade for driving fasteners supplied from a magazine carried by the body and supporting a row of nails. A pusher urges the nails along a feed path in the magazine. Individual nails are advanced from the magazine to a drive position in the drive track by an escapement mechanism, and an advanced nail is held in the drive position by a magnet assembly. The tool magazine is quickly and conveniently loaded with nails supplied in an oriented condition from a loading chute. The loading operation is automatic in response to engagement of the magazine with the chute, and does not require awkward manipulation of the pusher. Coupling members on the magazine and on the chute are mated by means of ramp and guide structures. In the mated position, stops in the nail path are opened to permit nails to slide from the chute into the magazine.

6 Claims, 31 Drawing Figures

40
44
46
48
50
54
58
60
68
70
72
82
86
94
98
102
106
110
114
122
124
128
130
132
134
142
144
146
152
154
156
158
164
206
208
210
212
216
224
226
228
230
231
234
235
236
237
240
244
246
248
252
254
256
258
260
262
264
266
268
270
272
276
284
290
292
298
300
302
304
306
308
310
312
316
318
320
42
6
7
9
21
22
28

50
70
66
90
88
86
146
144
80
140
84
78
128
126
134
124
138
122
212
94
68
42
92
142
136
40
4
226
224
164
82
158
160
180
174
237
236
235
234
56
64
46
48
152
62
156
231
154
162
52
216
232
54
60

240
244
246
250
252
254
256
258
260
262
266
268
270
272
274
276
278
280
282
284
286
288
290
292
296
298
300
302
304
306
308
310
312
314
316
318
320
42
50
66
70
78
80
82
84
86
88
90
92
94
98
110
114
31

FASTENER TOOL LOADING ASSEMBLY

The present invention relates to improvements in assemblies for loading uncollated fasteners such as nails supplied in bulk or loose condition into fastener driving tools.

Subject matter disclosed in the present application is claimed in the copending application of Geist et al, Ser. No. 256,409, filed on the same day as this application, and entitled FASTENER DRIVING TOOL.

Power operated nail driving tools of a type widely used in the past are supplied with nails in collated form. For example, such tools may utilize strips or sticks of similarly oriented nails held in collation by lengths of formed plastic, wire or other material surrounding or secured to the nails. In another type of fastener collation, nails or other fasteners are frictionally held by a plastic carrier strip capable of being coiled. Although tools for driving collated fasteners have achieved very wide acceptance, the necessity for manufacturing strips or coils of fasteners in reflected in the cost of using such tools. Consequently, it would be desirable to provide a tool capable of driving uncollated fasteners. The term "uncollated" is used here to denote fasteners which may be uniformly oriented but which are not held in a collated form by strips or carriers or material other than the fastener driving tool itself.

Attempts have been made in the past to provide tools capable of driving uncollated fasteners. However, tools of this type have been subject to difficulties including difficulty and inconvenience in loading fasteners into the magazine. Among the objects of the present invention are to provide an improved assembly for loading uncollated fasteners into a fastener driving tool; to provide a loading assembly wherein loading of fasteners into the magazine of a tool is easily and conveniently accomplished; and to provide a fastener driving tool loading assembly for uncollated fasteners overcoming disadvantages encountered with mechanisms for this purpose developed in the past.

In brief, in accordance with the above and other objects and advantages of the present invention, there is provided a power tool for driving uncollated fasteners having shanks and heads into a workpiece. The tool includes a tool body having a nose portion defining a drive track. A magazine assembly carried by the tool body includes guides supporting a row of fasteners in a feed path intersecting the drive track at a fastener drive position. A pusher urges the row of fasteners toward the drive position. A driver blade moves in the drive track from a static position through the drive position in a drive stroke followed by a return stroke to the static position. An escapement mechanism feeds the first fastener of the row from the magazine feed path to the drive position in timed sequence with the driver blade movement.

The magazine includes an elongated base frame member having a similar cross section throughout its length. A fastener head slideway is defined by an upper portion of the frame member, and a depending portion of the frame member supports a first guide for one side of the fastener shanks. An elongated tubular member on the opposite side of the shanks defines a second guide for the fastener shanks. The pusher is slideable along the magazine and a spring urges it in the direction of the drive track. A feed pawl is resiliently mounted on the pusher and engages fasteners in the feed path to continuously urge the row of fasteners toward the drive track and escapement mechanism. The pawl is provided with a cam for retracting the pawl from the feed path when the pusher is retracted over fasteners loaded in the magazine.

A fastener loading opening is provided in the end of the magazine spaced from the drive track. A fastener stop blocks the fastener loading opening, and is selectively removable from the feed path for loading of fasteners. Fasteners can be loaded without prior manipulation of the pusher, and the pusher can simply be retracted after the loading operation has been completed. An inclined chute containing a supply of fasteners to be loaded terminates in an exit coupling matable with a feed coupling member defining the fastener loading opening in the magazine. A ramp formed on a projection of the exit coupling guides the loading coupling member into the mated position. Stops normally blocking the naim path at the ends of the chute and the magazine are opened in the mated position, and are closed in a sequence to assure no loss of nails.

The above and other objects and advantages of the present invention may be best understood with reference to the following detailed description of the embodiment of the present invention illustrated in the drawings, wherein:

FIG. 8 is a fragmentary view similar to a portion of FIG. 7 illustrating the pusher of the magazine assembly in the position corresponding to a desired minimum number of fasteners;

FIG. 16 is a sectional view showing part of the structure illustrated in FIG. 5 on an enlarged scale and illustrating the position of the escapement mechanism when the driver blade is in the static position;

FIG. 20 is a fragmentary side view of a loading chute for loading fasteners into the tool of FIG. 1;

Figures 1, 2D:
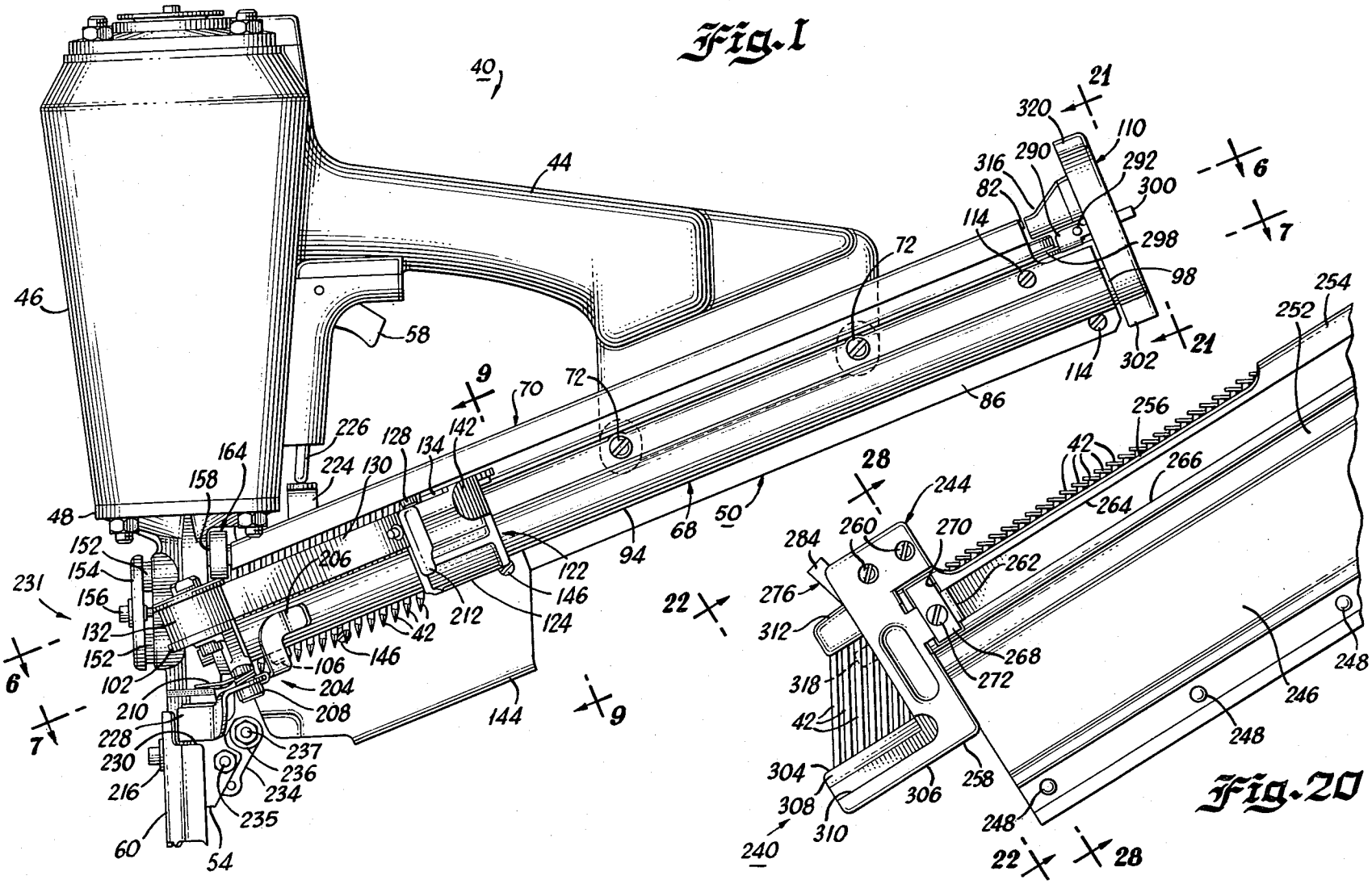
FIG. 1 is a side view of a fastener driving tool embodying the features of the present invention.

Having reference now to the drawings, and initially to FIG. 1, there is illustrated a fastener driving tool designated as a whole by the reference numeral 40 and constructed in accordance with the principles of the present invention. The tool 40 is a power tool serving to drive uncollated fasteners 42 into a workpiece. In the illustrated embodiment of the invention, the tool 40 is pneumatically powered and the fasteners 42 are nails. It should be understood that the principles of the present invention may be applicable to other types of power tools, and to tools for driving fasteners other than the illustrated nails.

Figures 3, 9, 10:
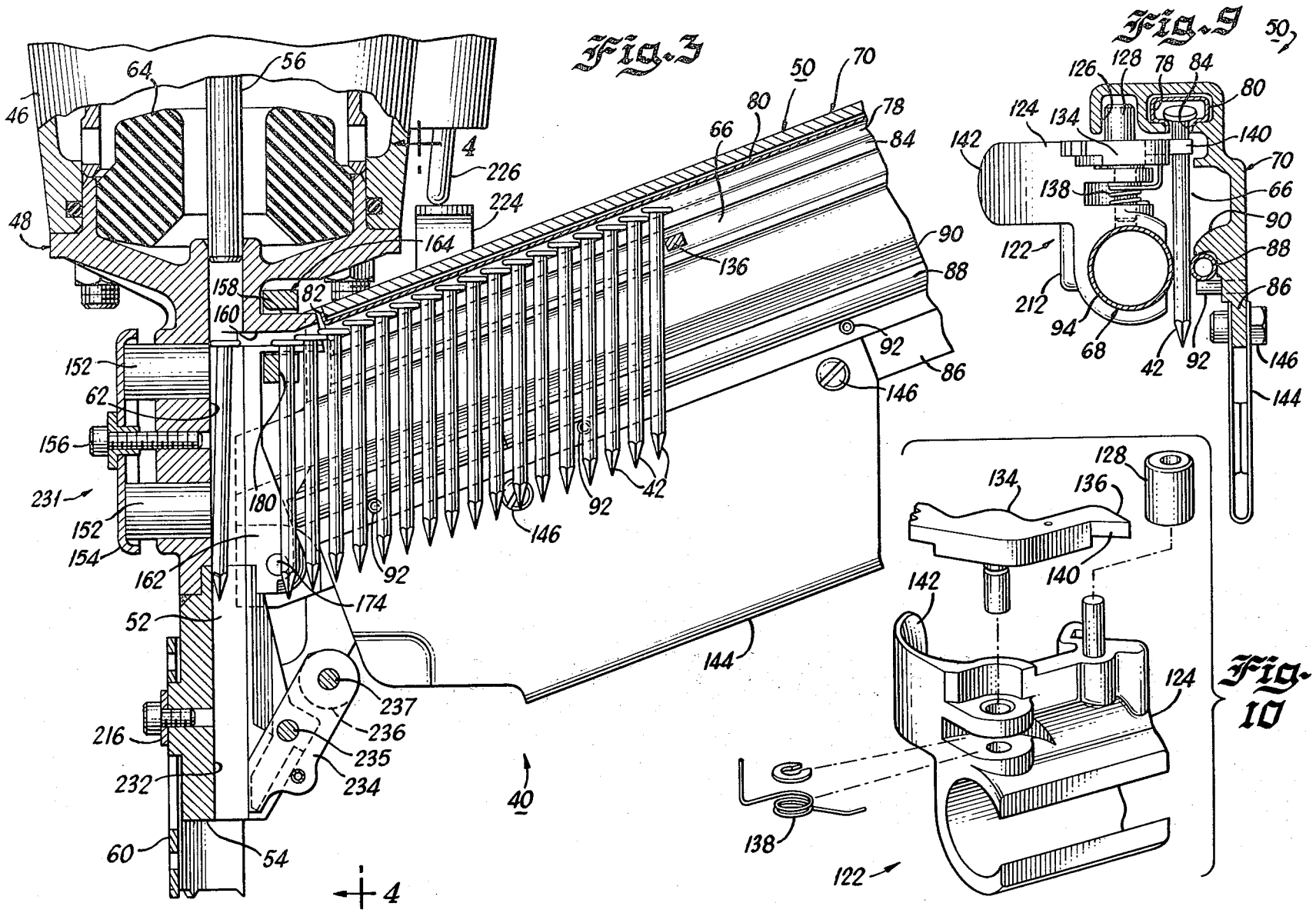
FIG. 3 is a sectional view taken along the line 3—3 of FIG. 2.
FIG. 9 is a sectional view on an enlarged scale taken along the line 9—9 of FIG. 1.
FIG. 10 is an exploded perspective view on an enlarged scale of the magazine pusher assembly.

In general, the tool 40 includes a tool body having a handle 44 and a head 46 to which a nose structure 48 is fastened. A magazine assembly generally designated as 50 is supported between the handle 44 and the nose structure 48. As best seen in FIG. 3, the nose structure 48 defines a drive track 52 extending from the head 46 to a workpiece directed end 54 of the nose structure. A driver blade 56 is illustrated in FIG. 3 in a static position. When a fastener driving operation is initiated by operation of a trigger 58 (FIG. 1) and by engagement of a safety yoke 60 against a workpiece, the blade 56 is moved forcibly through the drive track in a fastener drive stroke by a pneumatic drive system of any conventional type. During the drive stroke, the blade 56 engages a nail 42 retained at a drive position 62 in the drive track 52 and drives the nail 42 into a workpiece. At the end of the drive stroke, when a drive piston (not shown) strikes a bumper 64, the pneumatic drive system initiates a return stroke in which the blade 56 is returned to the static position illustrated in FIG. 3.

Magazine assembly 50 supports a row, i.e., a single file array, of nails 42 and defines a feed path 66 for movement of the nails 42 toward the drive position 62 in the drive track 52. An adjustable guide mechanism generally designated as 68 permits the feed path width to be tailored to the nail shank size for reliable and jam free feeding of nails 42.

Proceeding to a more detailed description of the magazine assembly 50, it includes an elongated base frame member 70 having a similar cross section throughout its length. Preferably, member 70 may be an extrusion. A pair of fasteners 72 secure the base frame member 70 to the tool handle 44 and an additional fastener 74 secures the frame member to a boss 76 (FIG. 11) on the nose structure.

Figures 11, 12:
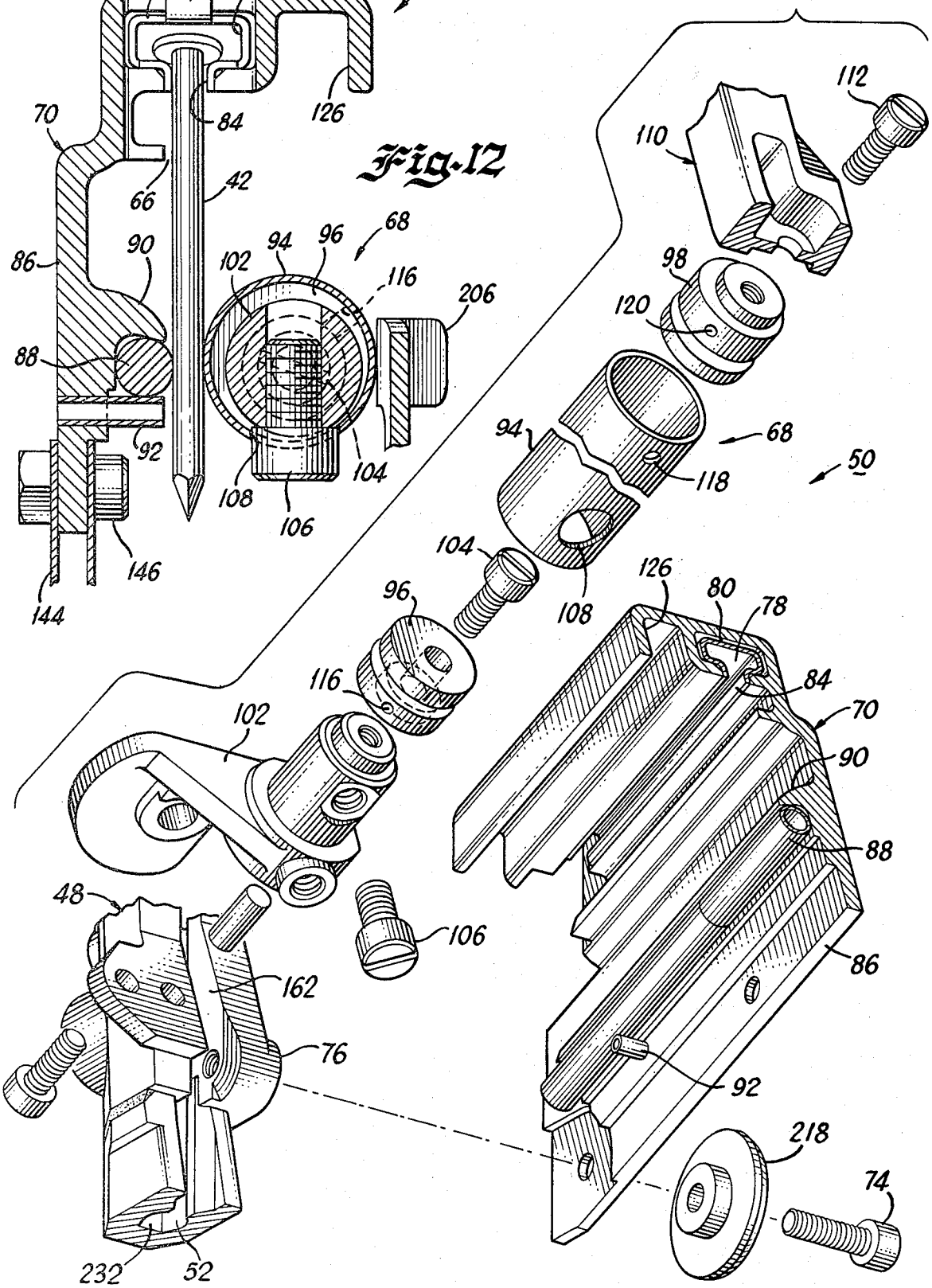
FIG. 11 is an exploded perspective view illustrating elements of the magazine assembly.
FIG. 12 is a sectional view on an enlarged scale taken along the line 12—12 of FIG. 7.

An upper portion of the base frame member defines a slideway 78 for the heads of the nails 42. In order to reduce friction and wear, a liner 80 of a material such as a stainless steel plated with an extremely hard chrome alloy having low friction and high durability characteristics is inserted into the slideway 78 and is held in position by tab portions 82 folded into engagement with the base frame member at the opposite ends of the slideway 78 (FIGS. 1, 3 and 12). The slideway 78 includes a slot 84 larger than the nail shanks and smaller than the heads so that the heads are captured in the slideway and are slideably movable along the length of the magazine. Slot 84 is defined between two turned down edges or flange portions of the liner 80. The interfacing surfaces of these flanges reduce friction between the shanks of fasteners 42 and the liner 80.

The base frame member 70 includes a depending, flange-like portion 86 along which is supported a guide member 88 engageable with one side of the shanks of the row of nails 42. The guide 88 is captured between a retaining flange 90 formed on the depending flange 86 and a number of press fitted roll pins 92. To provide ample strength in the region of the nose structure 48, the forward portion of guide 88 is a single rod, while the rearward portion is tubular to avoid unnecessary weight. The guide 88 is fabricated of a material such as stainless steel of desired low friction and high strength characteristics.

Free sliding movement of the nails 42 is encouraged by the adjustable guide mechanism 68 (FIGS. 7, 9 and 11) including a tubular guide member 94 extending parallel to and spaced from the guide 88. Tube 94 is formed of a suitable material such as a stainless steel and is supported by and suspended between a pair of plug members 96 and 98 received in the opposite ends of the tube 94. Each plug is provided with an O-ring to insure that the tube 94 is held with no looseness or play, and providing a swivel-like mounting for the ends of the tube to assure that the tube is not distorted when clamped in place if the plug members 96 and 98 are not perfectly aligned.

Eccentricity of the plug members 96 and 98 permits adjustment of the tubular guide member 94 to vary the spacing between the guides 94 and 88. This spacing should be tailored to the nail shank size in order to resist any tendency of the nail shanks to ride over one another and become jammed or fail to slide freely along the feed path 66 (FIG. 3). In this respect, it should be noted that for convenience in illustration the nails 42 are illustrated in the drawings in an oriented condition wherein all the shanks are parallel. In use of the tool, the tool may be held and operated in many positions other than the illustrated vertical position and the nail shanks may assume a variety of configurations wherein they are not necessarily parallel to one another.

Figure 6:
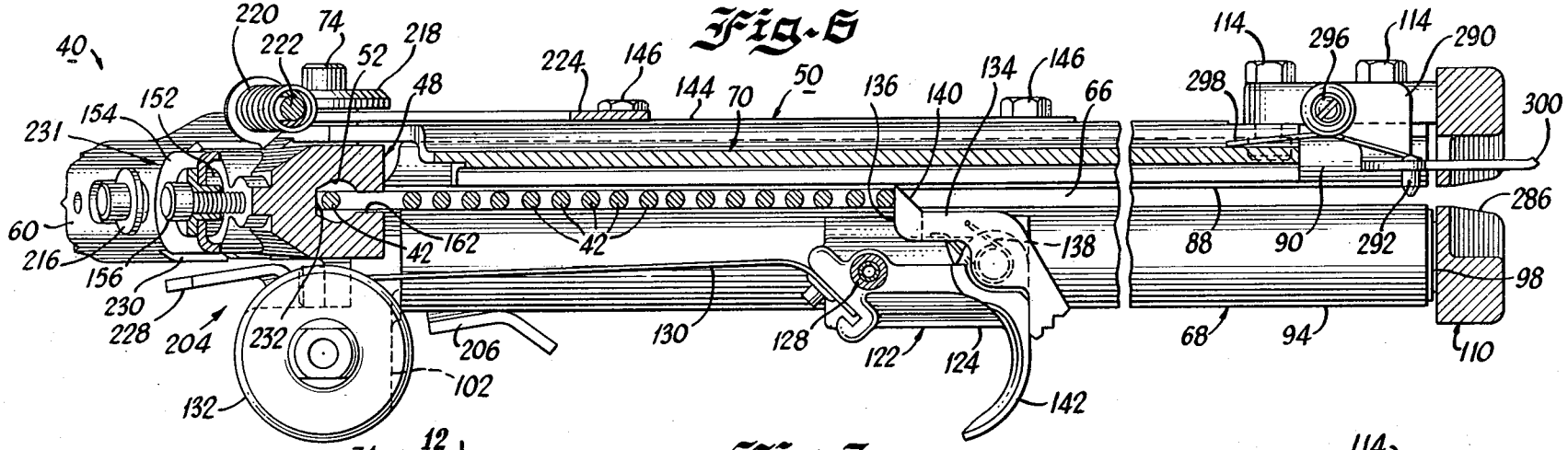
FIG. 6 is a sectional view on an enlarged scale taken along the line 6—6 of FIG. 1.
Figure 7:
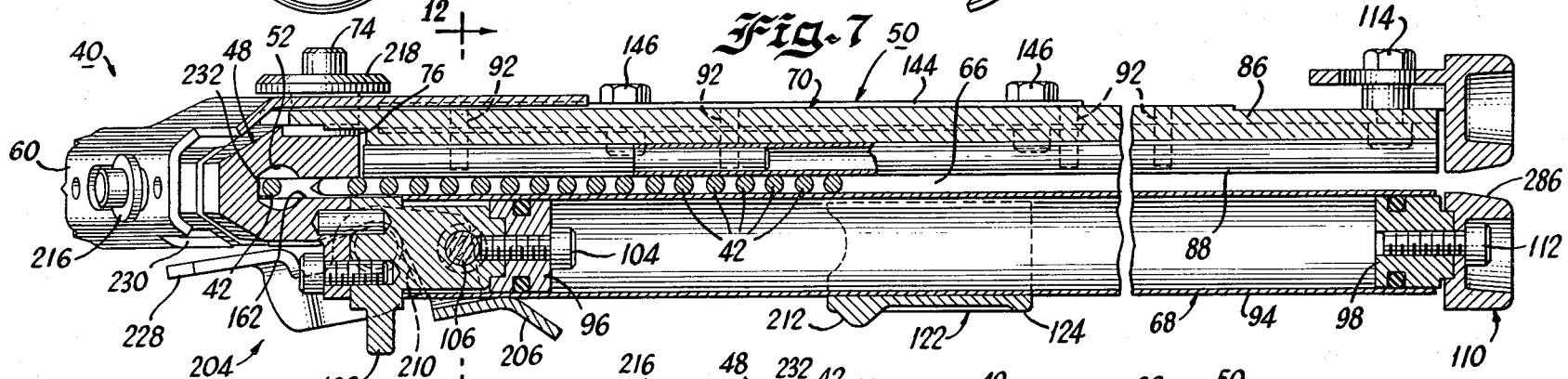
FIG. 7 is a sectional view on an enlarged scale taken along the line 7—7 of FIG. 1.
Figure 9:
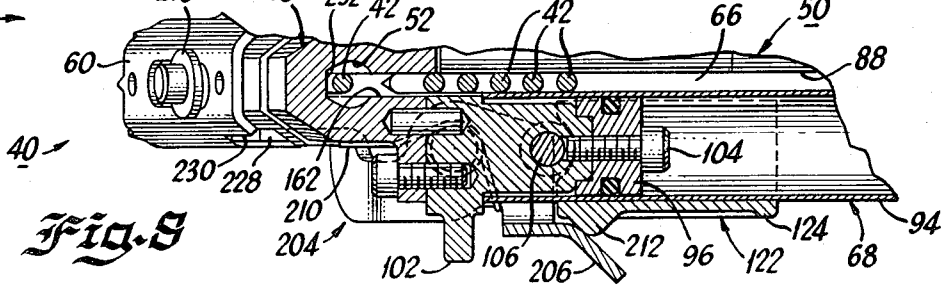

Adjustment of the feed path width is accomplished by rotational adjustment of the plug members 96 and 98 (FIG. 11). Plug member 96 is attached to a negator spring support bracket 102 (FIGS. 7 and 11) by means of a fastener 104, and a fastener 106 also secured to bracket 102 has a head received in an opening 108 in the tube 94. The plug member 98 is held to a loading feed coupling member 110 by a fastener 112, and the coupling member 110 is fastened to the magazine base frame member 70 by fasteners 114 (FIGS. 6 and 7).

To adjust the position of the tube 94, (FIG. 11) the fasteners 114 are removed, the coupling member 110 with the plug member 98 attached thereto is removed from the end of the tube 94, the fastener 112 is loosened, and the tube 94 is removed from the plug member 96 after withdrawing the fastener 106 from the hole 108. Fastener 104 is then loosened and the rotational position of the plug member 96 is adjusted, as by inserting a small tool into an opening 116 provided in the plug member 96. When the desired position is obtained, the fastener 104 is retightened, and the tube 94 is placed over the plug member 96. At this point, the coupling member 110 may be reinstalled with the plug member 98 in the opposite end of the tube 94. Openings 118 and 120 in the tube 94 and plug member 98 are aligned and engaged with a tool to rotate the plug member 98 until a consistent spacing is obtained throughout the length of the feed path 66. In this position, the fastener 112 is tightened and the tube 94 is rotated to permit reinstallation of the fastener 106 through the opening 108.

The row of fasteners supported in the magazine assembly 50 is continuously urged along the feed path 66 toward the nose structure 48 and the drive track 52 by means of a pusher assembly generally designated as 122. Since gravity alone need not be relied upon to feed the nails 42 toward the drive position, the tool 40 can be operated in many positions, for example to drive fasteners into a vertical workpiece.

Pusher assembly 122 includes a pusher member 124 partially encircling and slidable along the tubular guide member 94. A guide track 126 is formed in the magazine base frame member 70 (FIG. 9) and a guide roller 128 supported by the pusher member 124 is received in the guide track 126 in order to maintain the pusher member in its proper orientation while permitting its sliding movement along the length of the magazine. Forward movement of the pusher member is limited by engagement with the head of fastener 106 (FIG. 8) and rearward movement is limited by engagement with the coupling member 110. A negator spring 130 (FIGS. 2 and 4) extends from a spring reel 132 mounted on the bracket 102 and is attached to the pusher member 124 for continuously urging the pusher member toward the nose structure 48.

A pawl lever 134 (FIG. 10) pivotally mounted on the pusher member 124 includes a pawl 136 engagable with shanks of nails 42 in the nail feed path 66 for pushing the row of nails toward the drive position. A pawl spring 138 biases the pawl 136 into the feed path. The pawl is provided with a cam surface 140 so that when the pusher is moved rearwardly by means of a handle 142, engagement of the nails shanks against the cam surface 140 pivots the pawl lever 134 against the force of the spring 138 to move the pawl 136 out of the feed path.

When driving nails 42 downwardly into a horizontal surface, gravity is sufficient for the advancement of nails 42 along the feed path 66. In this case the pusher assembly 122 need not be used, and can be left in its forwardmost position. Pawl spring 138 is sufficiently weak as to permit nails under the force of gravity to deflect the pawl 136 by engagement with cam surface 140.

A magazine guard 144 is mounted at the end of the magazine assembly 50 adjacent the nose structure 48. The guard 144 is a sturdy, U-shaped sheet metal structure (FIGS. 3 and 9) secured to the depending flange portion 86 of the magazine base frame member 70 by fasteners 146. The points of nails 42 in the feed path 66 are protected by the guard, and the guard also provides a strong and substantial surface which an operator of the tool may use to position workpiece members or the like. This prevents damage to the magazine itself, and also prevents damage to the nose assembly 48 since the use of the nose to manipulate a workpiece is discouraged. The guard 144 is easily replaced in the event of damage or wear without disassembly of the tool.

Individual nails 42 are advanced from the row of nails held in the magazine assembly 50 by means of an escapement mechanism generally designated as 150 (FIG. 13) operating in timed relationship with movement of the driver blade 56. The first nail 42 of the row of nails is moved by the escapement mechanism 150 from the magazine assembly 50 and into the drive position 62 so that a nail is in the drive position prior to each drive stroke. A nail is retained in the drive position as shown in FIG. 3 by means of a pair of identically shaped magnets 152 supported in openings in the nose structure 48 by means of a clamp member or cap 154 held by a fastener 156, as described in more detail below. Nose structure 48 includes a projection 158 (FIGS. 3 and 13) defining a recess 160 accommodating the heads of nails 42 as they move between the magazine nail feed path 66 and the drive position 62. A slot 162 permits entry of the nail shanks into the drive track 52. The projection 158 mates with the end of the slideway 78 in the base frame member 70 so that a continuous path is provided for movement of the nails 42.

Figure 18:
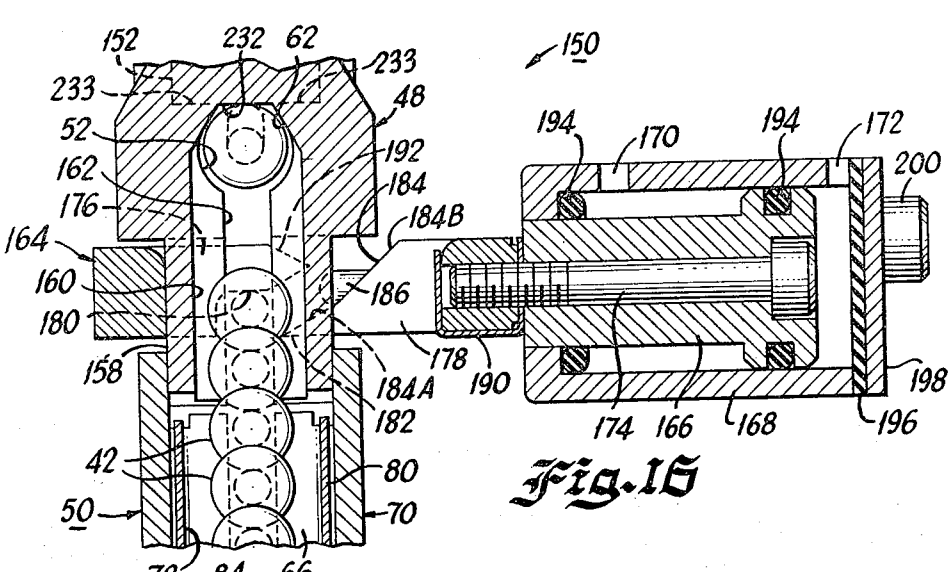
FIG. 18 is a view similar to FIG. 16 illustrating the mechanism at the end of a drive stroke.
Figure 19:
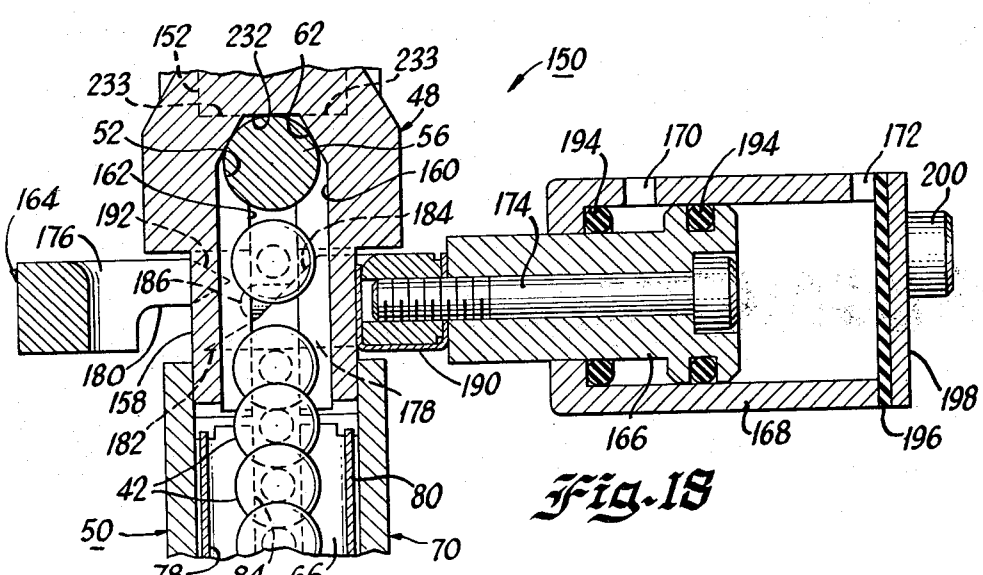
Figures 21, 22, 23, 24, 25, 26:
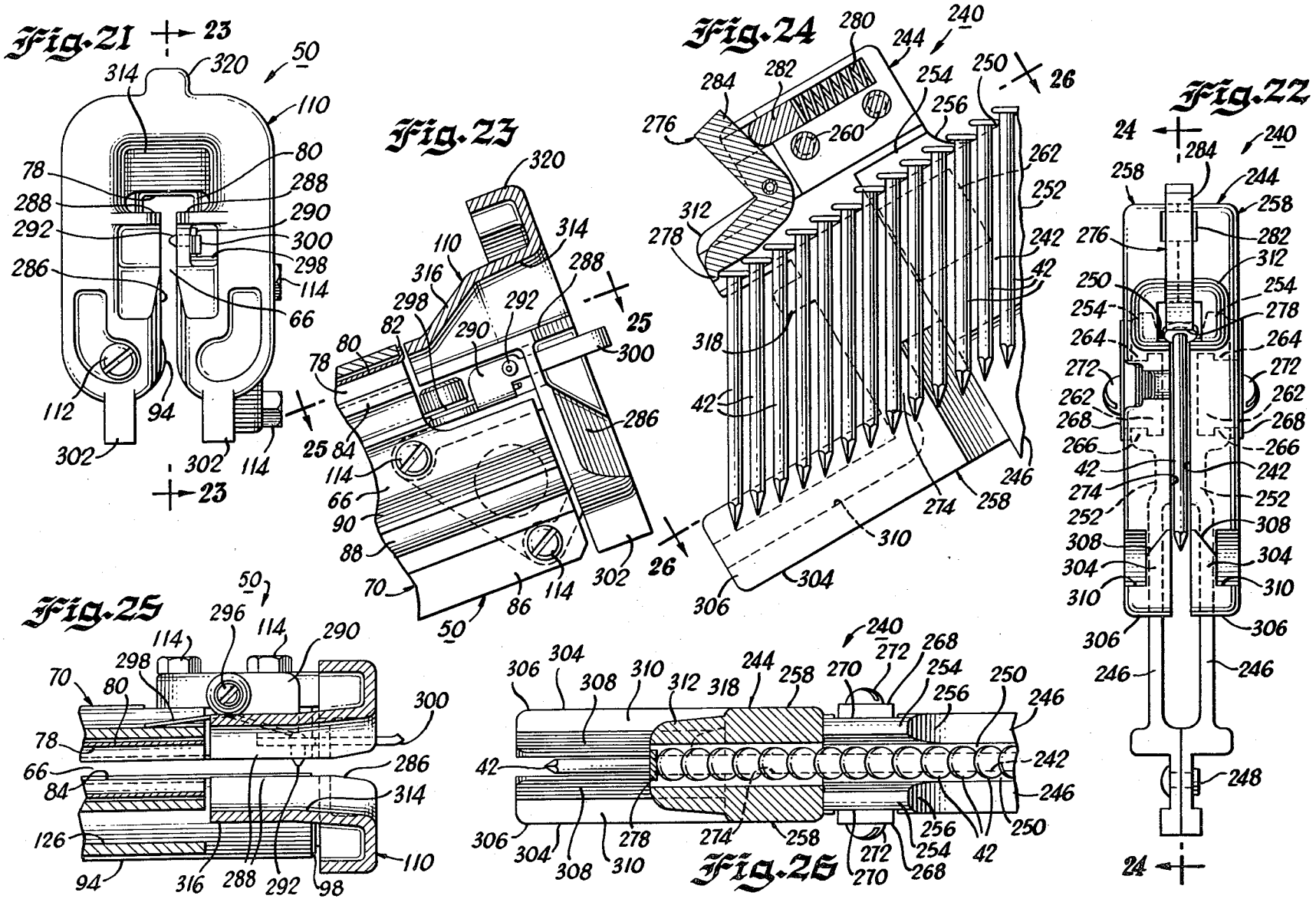
FIG. 21 is an end view of the magazine of the tool taken from the line 21—21 of FIG. 1.
FIG. 22 is an end view of the loading chute taken from the line 22—22 of FIG. 20.
FIG. 23 is a sectional view taken along the line 23—23 of FIG. 21.
FIG. 24 is a sectional view taken along the line 24—24 of FIG. 22.
FIG. 25 is a sectional view taken along the line 25—25 of FIG. 23.
FIG. 26 is a sectional view taken along the line 26—26 of FIG. 24.

An escapement member 164 of unitary, one-piece construction surrounds the nose structure projection 158 and includes a recess larger than the projection so that the shuttle gate 164 can move transversely relative to the projection between the limit positions illustrated in FIGS. 16 and 18. Since the projection 158 is part of the nose structure defining the drive position in the drive track, and since the movement and positioning of the escapement member 164 is determined by guiding engagement with the projection 158, reliable and accurate operation of the escapement mechanism 150 is assured.

The escapement member 164 is operated by means of a feed piston 166 received within a feed cylinder 168 carried by the nose structure 48. In the static position of the driver blade 56, the smaller area side of a differential area feed piston 166 is subjected to pressure by means of a continuously pressurized passage 170 (FIG. 4) extending to the pneumatic drive system of the tool. During a drive stroke of the driver blade 56, the opposite, larger area side of the piston 166 is subjected to pressure by way of a passage 172 (FIG. 2) extending to a suitable point in the pneumatic system of the tool. As a result of the area differential, during a drive stroke the piston 166 moves from the position illustrated in FIGS. 2, 4, 5 and 16, through the position illustrated in FIG. 17 and to the position illustrated in FIG. 18. During a return stroke of the driver blade 56, the passage 172 is vented and the pressure in passage 170 returns the piston 166 to the static position shown in FIGS. 5 and 16.

Escapement member 164 is attached to the feed piston 166 by means of a fastener 174. As result, the escapement member 164 moves together with the piston 166 in a synchronized or timed relationship with respect to movement of the driver blade 56.

The escapement member 164 includes a pair of opposed legs 176 and 178 disposed in the region beneath the recess 160 in the projection 158. The leg 176 forms a stop member disposed in the fastener feed path in the static condition illustrated in FIG. 16. In this position, a stop surface 180 on the stop member 176 is engaged by the shank of the first nail 42 to stop the row of nails from advancing in the magazine. The leg 178 forms a separator member which is clear of the feed path in the static position and which is aligned with the space between the shanks of the first and second nails 42.

Figure 17:
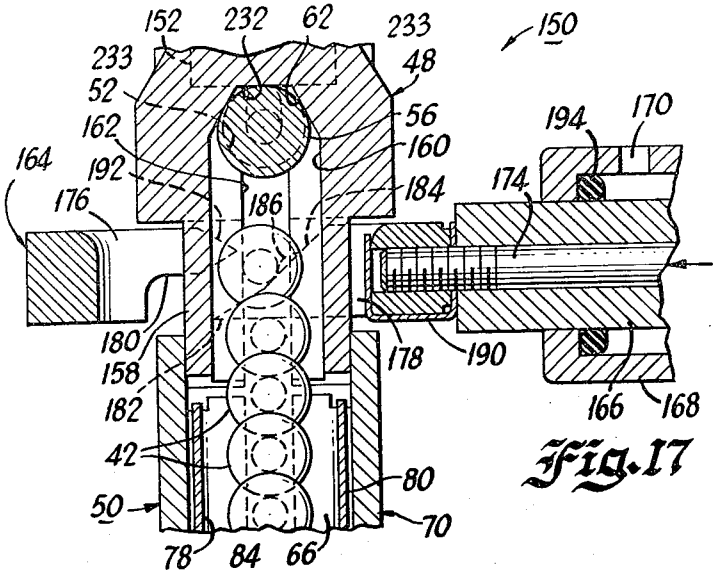
FIG. 17 is a view similar to part of FIG. 16 illustrating the mechanism during a driver blade drive stroke.

During a drive stroke of the driver blade 56, as sequentially illustrated in FIGS. 17 and 18, the stop member 176 retracts from the feed path 66 and the separator member 178 enters the feed path. The separator member includes a point 182 assuring entry of the separator member between the first and second fastener shanks. In addition, the separator member 178 includes a cam surface 184 for positively advancing the first nail 42 along the recess 160 toward the drive position 62.

Figures 13, 14, 15:
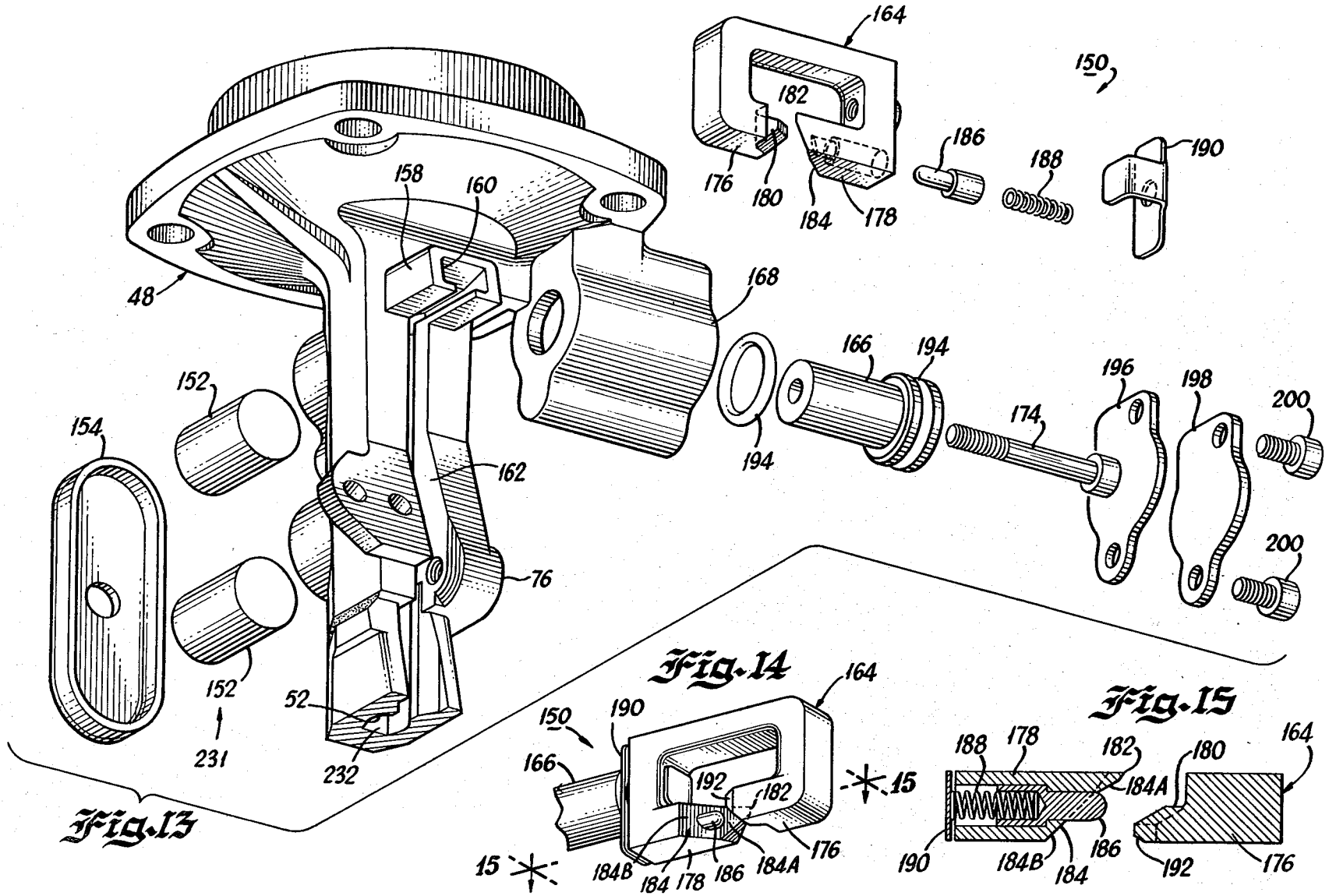
FIG. 13 is an exploded perspective of portions of the nose structure and escapement mechanism.
FIG. 14 is a perspective view of the opposite side of a portion of the escapement mechanism.
FIG. 15 is a sectional view on an enlarged scale taken along the line 15—15 of FIG. 14.

In view of the fact that the tool 40 can be used in many different positions, the first nail 42 may not initially be in the properly oriented position parallel to the drive track illustrated, for example, in FIG. 3. Even in the orientation shown in FIG. 3 it is desirable that the point of the nail be propelled into the drive track adjacent the magnets 152. In order to urge an advancing fastener into the proper orientation, the separator member 178 is provided with a resilient bumper in the form of a spring biased pin 186. As best illustrated in FIGS. 13 and 15, the pin is slidably received in a recess in the separator member 178, and is urged by a spring 188 so that normally the nose of the pin projects outwardly from the cam surface 184. The spring is held in compression against a clip 190 provided to maintain the pin and spring in assembly as the escapement member 164 is mounted on the projection 158 and prior to attachment of the feed piston 166.

As a nail 42 is advanced by the cam surface 184, the nail shank moves between the cam surface 184 and the opposed surface of the stop member 176. These interfacing surfaces define a pathway for movement of the nail shank through the escapement member 164. This pathway is obstructed by the projecting pin 186, and as a result the advacing nail shank depresses the pin 186 and compresses the spring 188.

Cam surface 184 includes a leading portion 184A (FIG. 15). This portion is sharply inclined relative to the fastener feed path to provide a substantial mechanical advantage both for initiating the motion of the first nail and for providing ample force for retraction of the pin 186. The cam surface 184 includes a trailing portion 184B of less inclination relative to the drive path for increasing the rate of advance of the nail 42.

As the nail shank moves along the cam surface 184 beyond the depressed pin 186, the spring 188 returns the pin 186 to its fully projecting position. During this movement, the pin applies a force to the advancing nail shank to assure that the nail point is tipped or pivoted toward the drive track so that the nail 42 is urged to enter the drive position 62 in the proper orientation for retention by the magnets 152. The pin 186 permits the escapement member 164 to accommodate different nail shank diameters and avoids the need for close tolerances.

Figure 19:
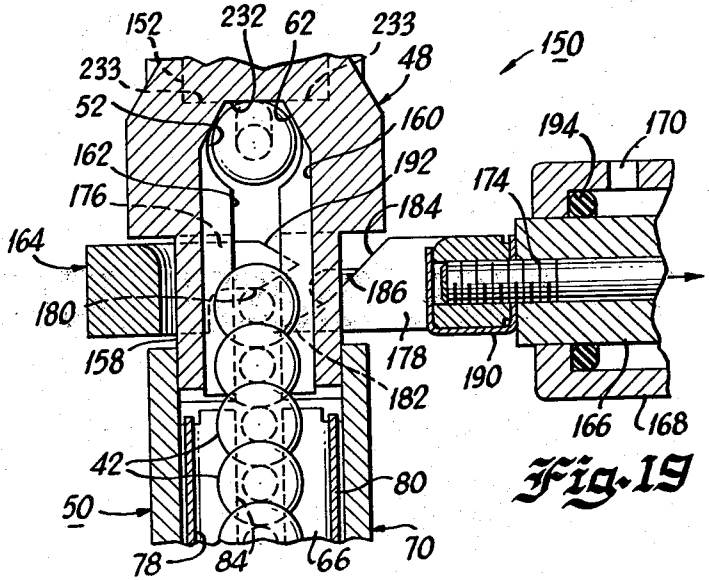
FIG. 19 is a view similar to part of FIG. 16 illustrating the mechanism during a driver blade return stroke.

When the escapement member 164 has reached the position illustrated in FIG. 18, the first nail 42 has moved through the pathway defined between the separator and stop members 178 an 176 and is disposed in the region between the driver blade 56 and the pin 186. As the driver blade commences its return stroke, the feed piston 166 begins to move in the opposite direction causing the separator member 178 to be withdrawn from the feed path and causing the stop member 176 to reenter the feed path. The stop member 176 is provided with a cam surface 192 for continuing the advancing motion of the first nail 42 from the position illustrated in FIG. 18 to the final position illustrated in FIG. 19. By the time that the driver blade 56 has moved through its return stroke to the static position, the next nail to be driven is positively advanced by the escapement mechanism 150 to the drive position where it is retained by the magnets 152. As the separator member 178 exits from the feed path, the row of nails advances incrementally so that the subsequent nail, now the first nail in the row, engages the stop surface 180 on the stop member 176 in position for advancement of that nail in timed relationship with the next drive stroke of the driver blade 56.

For accurate positioning of the components of the escapement mechanism 150 the feed cylinder 168 is formed as an integral part of the nose structure 48. The cylinder is sealed by means of O-rings 194 and by a gasket 196 captured beneath a cap 198 held to the feed cylinder housing by fasteners 200.

Advancement of the first nail 42 of the row of nails contained in the magazine assembly 50 is positively accomplished by the escapement mechanism 150 and is substantially independent of variable factors such as the force applied by the negator spring 130, the quantity or weight of the nails 42 in the feed path 66, and variations in friction along the feed path. For consistent operation, the tool is prevented from operating with less than a minimum number of a few nails 42 in the feed path 66. For this purpose, a lock out mechanism generally designated as 204 is provided.

Lock out mechanism 204 includes an interlock lever 206 pivotally supported on the negator spring bracket 102 by a fastener 208. A spring 210 normally biases the interlock lever 206 to the position illustrated in FIGS. 2 and 7. When a desired minimum number of nails 42 remain in the magazine assembly 50, a projection 212 on the pusher member 124 engages the lever 206 and moves it to the alternate position illustrated in FIG. 8.

Figure 2:
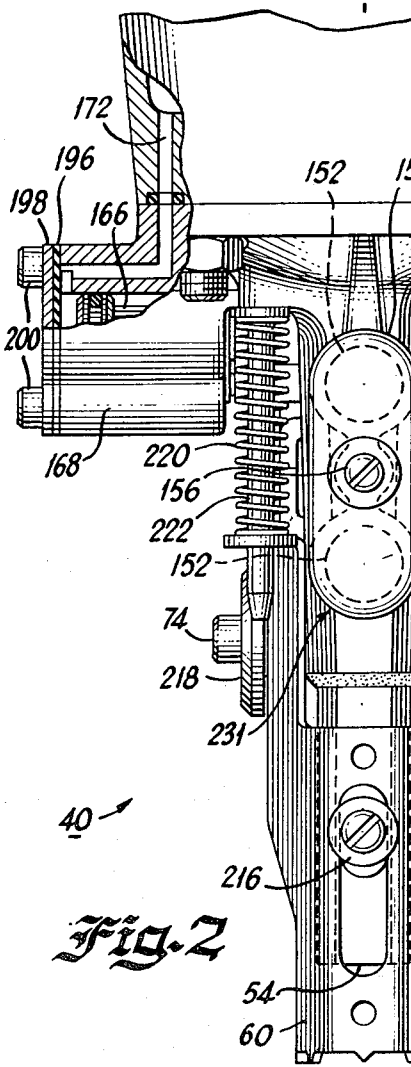
FIG. 2 is a partial front view, partially in section, of the tool of FIG. 1 shown in an enlarged scale.

As noted above, the tool 40 cannot commence a drive stroke until the safety yoke 60 is moved upwardly by engagement with a workpiece. The yoke 60 is slidably mounted with respect to the nose structure by engagement of a slot in the yoke with a fastener mounted guide bushing 216 (FIGS. 2 and 3) and by engagement of a second slot with a guide bushing 218 held by the fastener 74. The yoke 60 is biased to its downward position by a spring 220 surrounding a guide pin 222 (FIG. 2). The yoke 60 includes an arm 224 engagable with a link 226 (FIGS. 1 and 3) for enabling operation of the tool 40 when the yoke moves upwardly.

When the interlock lever 206 moves to the position of FIG. 8, an end portion 228 of the lever moves into a corresponding recess 230 in the yoke 60. As a result, the yoke 60 is prevented from moving in response to contact with a workpiece. This prevents further operation of the tool 40 until the pusher is retracted, and provides an indication to the operator of the tool that additional nails 42 are to be loaded into the magazine assembly.

Figure 4:
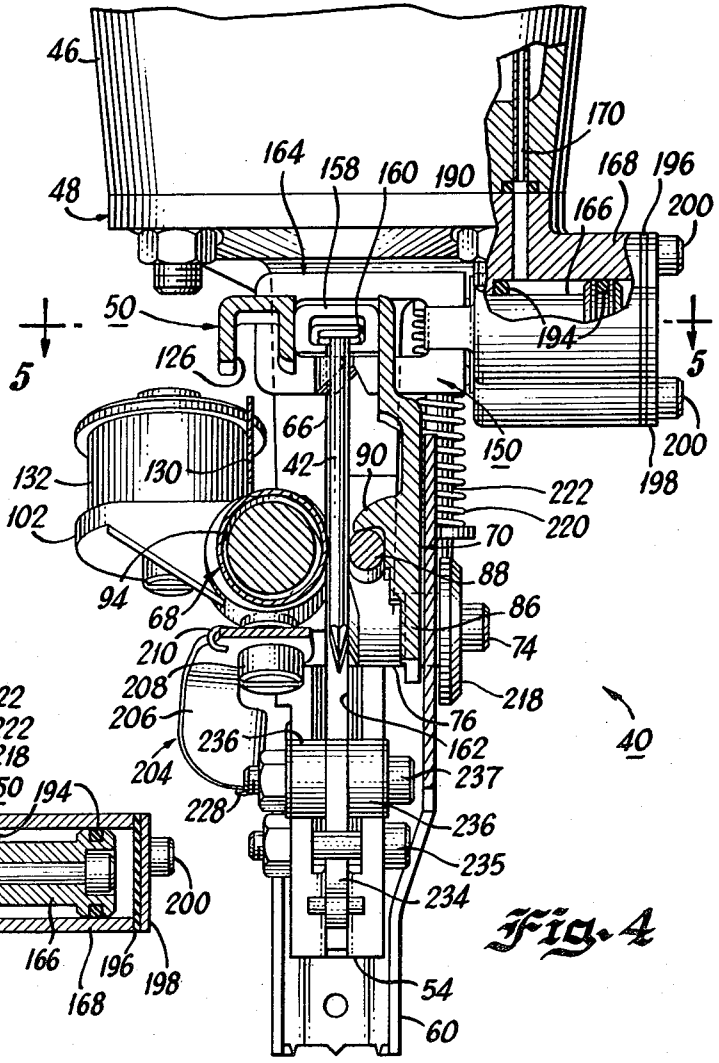
FIG. 4 is a sectional view taken along the line 4—4 of FIG. 3.
Figure 5:
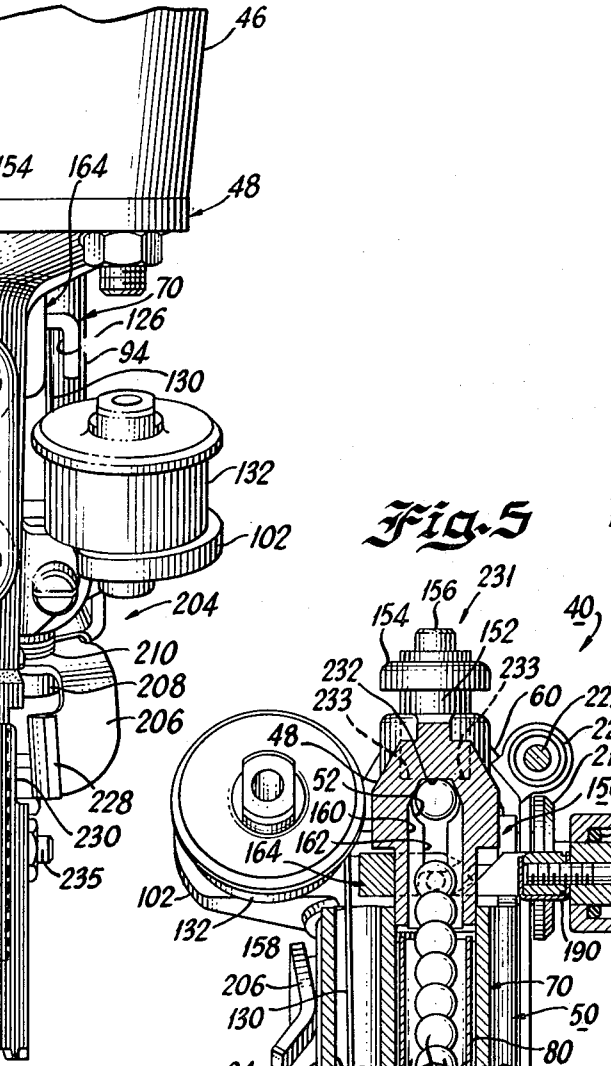
FIG. 5 is a partial sectional view taken along the line 5—5 of FIG. 4.

Magnets 152 are components of a magnet assembly generally designated as 231 best shown in FIGS. 2, 4 and 5. The nose structure 48 is formed of a stainless steel nonmagnetic material, and the two magnets 152 cooperate with the cap 154 of magnetic material to form an efficient generally U-shaped magnetic circuit. The ends of magnets 152 are adjacent the opposite ends of a nail 42 in the drive position 62, the nail completing the magnetic circuit and being firmly held in position.

Each magnet 152 is cylindrical and has a flat, planar end directed toward the drive track 52 (FIG. 5). The track 52 is somewhat teardrop shaped, and has a flat, planar wall portion 232. Magnets 152 are held in position with their end surfaces coinciding with drive track surface 232. This is accomplished by supporting the magnets in correspondingly shaped recesses having forward wall portions 233 (FIG. 5) coplanar with and extending to the sides of drive track surface 232. Fastener 156 is tightened until magnets 152 bottom on surfaces 233 so that the drive track is smooth and unobstructed and so that the magnets are as close as possible to a nail 42 in the drive position 62. A drop-off member 234 is associated with the lowermost end of the drive track 52 for guiding the point of a nail 42 in a drive stroke as it is propelled by driver blade 56 away from the magnets 152 and into a workpiece. Rather than being fixed, drop-off 234 is mounted for pivotal movement around a fastener 235. The force of gravity holds drop-off 234 in its normal position (FIG. 3) with its lower portion tangent to the drive track 52. During a drive stroke, the drop-off is maintained in this position by engagement of its lower tip against a workpiece. A stop pin 236 prevents the drop-off member from entering the drive track. Since the drop-off 234 is not fixed, the problem of jamming of a nail 42 wedged by the driver blade 56 in the drive track 52 is avoided. This type of jam is very difficult to clear due to high wedging forces. Since the drop-off 234 can easily move away from the drive track, ample room is provided for both a nail shank and the driver blade in the same area.

As no springs or other biasing members are used to bias the drop-off 234 in position, a sturdy construction with no easily broken components is provided. In order to prevent excessive stresses, for example on the fastener 235, a pair of resilient, elastomeric bumpers 236 are mounted on the upper end of the drop-off member 234 by a fastener 237. Bumpers 236 engage the body of the nose structure 48 to limit rotation of the drop-off and also serve to absorb the impact forces incident to a nail 42 striking the drop-off during a drive stroke when the drop-off may be abruptly and forcibly pivoted away from its normal position.

Figure 29:
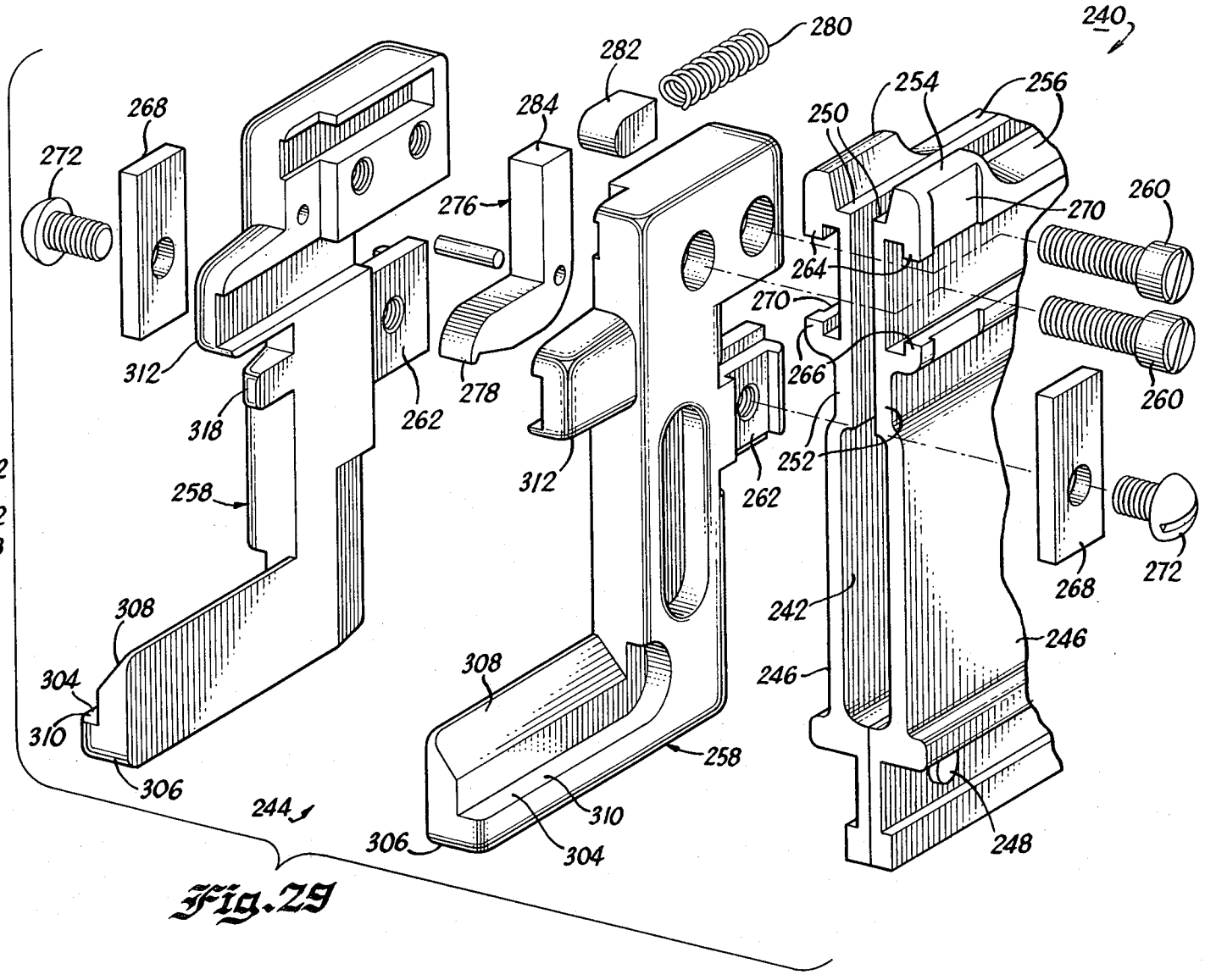
FIG. 29 is an exploded perspective view of the exit coupling associated with the loading chute.
Figure 28:
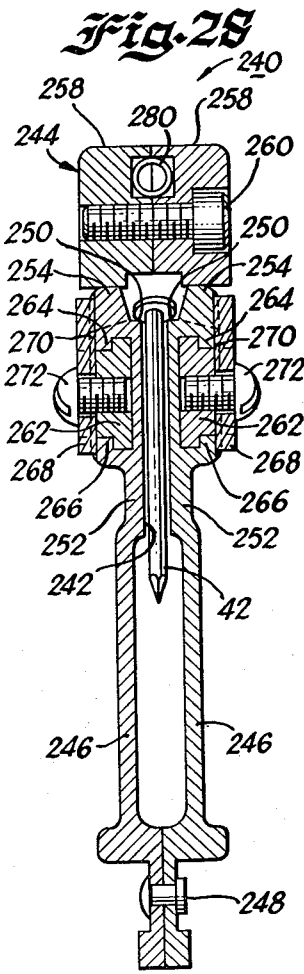
FIG. 28 is a sectional view taken along the line 28—28 of FIG. 20.

With reference now to FIG. 20, there is illustrated a loading chute designated in its entirety by the reference numeral 240. The chute 240 defines a loading path 242 (FIGS. 28 and 29) in which are stored a supply of nails 42 ready to be loaded into the magazine assembly 50 of the tool 40. Loading of nails 42 from the chute 240 into the magazine assembly 50 is accomplished automatically in response to engagement of the feed coupling member 110 with an exit coupling 244 associated with the loading chute 240.

Referring in more detail to the structure of the loading chute 240, a pair of similar, elongated rail members 246 are secured together by fasteners 248 and define therebetween the loading path 242. The rails include upper shelf portions 250 upon which the nail heads are received and from which the nails are suspended. Depending portions 252 of the rails 246 are spaced apart a sufficient distance to provide clearance for the nail shanks. Thickened upper portions 254 are formed into a recess 256 so that the heads of nails ready to be loaded are visible.

Exit coupling 244 includes a pair of generally similar body members 258 held together by fasteners 260. The exit coupling is secured to the end of the loading chute by insertion of tongue portions 262 of the body members 258 into grooves defined between a pair of ribs 264 and 266 in a tongue-and-groove relationship. This connection is secured by retaining keys 268 held in depressions 270 by fasteners 272. The exit coupling 244 defines an exit opening 274 aligned with the loading path 242 through which nails 42 slide during a loading operation.

Normally, nails 42 are retained in the loading path 242 by an exit stop lever 276 pivotally mounted on a pin extending between the body members 258. The lever 276 includes a catch portion 278 engageable with the head of the lowermost nail in the loading path 242. Lever 276 is biased to this position by means of a spring 280 operating through an actuator 282 engaging an upwardly extending operating leg of the lever 276.

Feed coupling member 110 is engageable with the exit coupling 244 during a nail loading operation. Coupling member 110 defines a fastener loading opening 286 aligned with the exit opening 274 in the mated condition. Opening 286 leads to a shelf structure 288 by which the nail heads are supported in movement from the loading chute 240 to the slideway 78 in the magazine assembly 50.

A nail stop lever 290 includes a nail stop projection 292 normally extending into the path of movement of nails between the loading opening 286 and the nail feed path 66. Lever 290 is pivotally mounted by means of a bushing and fastener 296. A spring 298 biases the nail stop lever 290 to its normal position, from which it may be deflected by movement of an operating arm portion 300 of the lever.

Engagement of the magazine assembly 50 with the loading chute 240 is facilitated by the provision of ramp and guiding structures on the couplings 110 and 244. The loading coupling 110 includes guide structure in the form of a pair of depending legs 302. To begin a loading operation, these legs are placed downwardly against a ramp structure 304 defined on projecting portions 306 of the exit coupling body members 258. The ramp structure 304 includes inclined or beveled surfaces 308 which guide the descending legs 302 onto guiding and supporting surfaces 310. With legs 302 resting on surfaces 310, the tool 40 with the magazine assembly 50 is simply slid into the mating position.

As the couplings 110 and 244 move toward one another, a guide nose 312 of the exit coupling 244 enters a cooperating recess 314 defined by a wall portion 316 of the coupling member 110. When the couplings 110 and 244 are mated, the loading path 244 is aligned with the feed path 66, and the exit opening 274 is adjacent the fastener loading opening 286.

Figures 27, 30, 31:
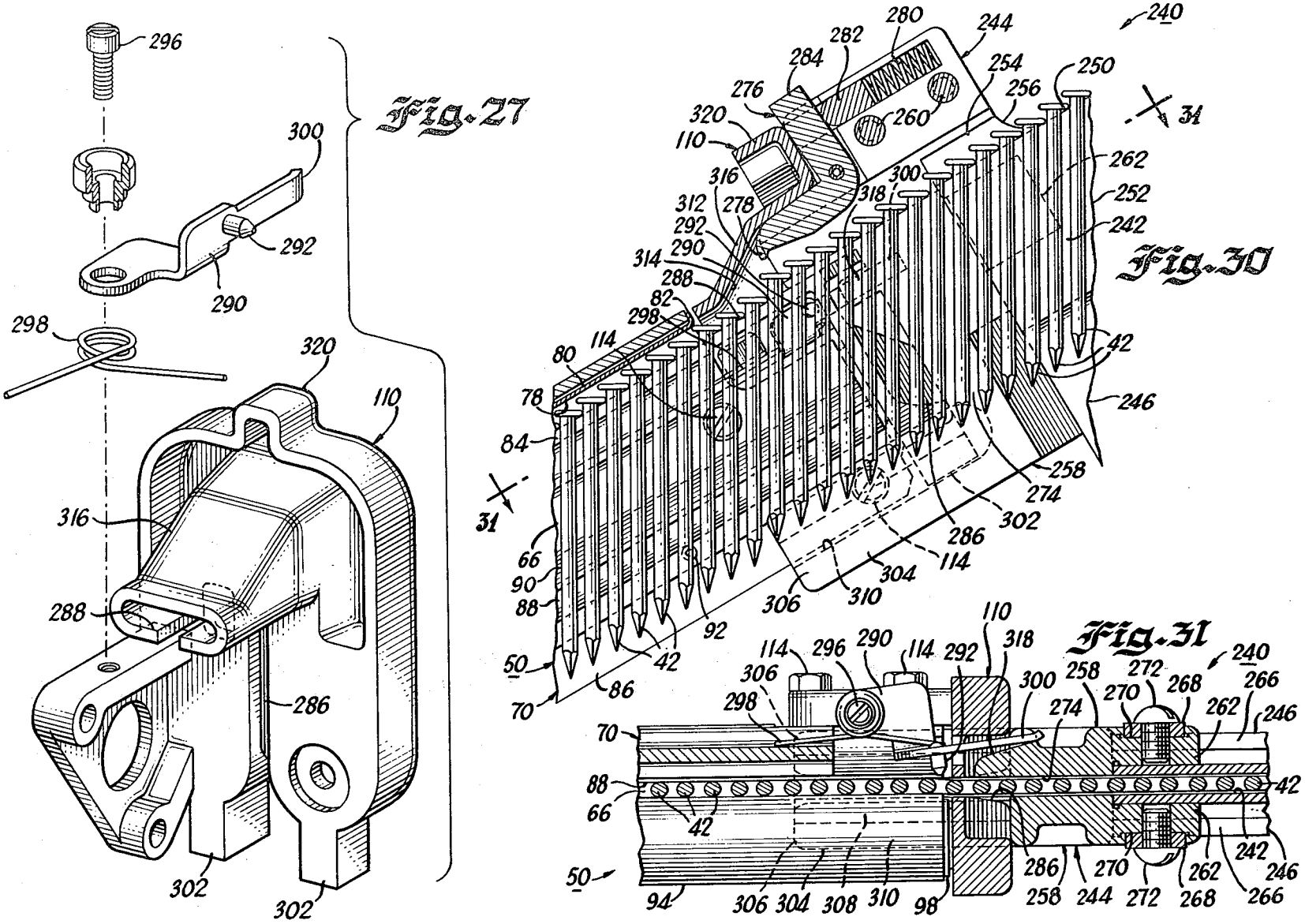
FIG. 27 is an exploded perspective view of the feed coupling member associated with the tool magazine.
FIG. 30 is a sectional view similar in parts to FIGS. 23 and 24 illustrating a loading operation.
FIG. 31 is a sectional view taken along the line 31—31 of FIG. 30.

As the couplings 110 and 244 move together, an actuating projection 318 on one of the exit coupling body members 258 engages the operating arm 300 of the nail stop lever 290. The stop projection 292 is consequently moved clear of the nail feed path 66 to permit entry of nails 42 into the magazine assembly 50. As the coupling is moved closer together, a projection 320 on the coupling member 110 engages the operating leg 284 of the exit stop lever 276 to pivot the lever and lift the catch portion 278 out of the loading path 242. In this mating condition, as seen in FIGS. 30 and 31, nails 42 slide freely from the loading chute 240 into the magazine assembly 50.

At the completion of the loading operation, the magazine assembly 50 is withdrawn from the loading chute 240. During the withdrawing motion, the projection 320 first disengages the operating leg 284 of the exit stop lever. The catch 278 descends into the loading path 242 to prevent further movement of nails 42 from the loading chute 240. During continuing movement of the magazine assembly 50 from the loading chute 240, the projection 318 disengages the operating arm 300 of the nail stop lever 290 and the projection 292 reenters the nail feed path 66 in the magazine assembly 50 to prevent loaded nails 42 from moving out of the magazine assembly 50. Since the loading chute is blocked prior to the blocking of the magazine, loss of nails is avoided.

It is not necessary to manipulate the pusher assembly 122 prior to or during the loading operation. Rather, after the loading operation is completed, the pusher assembly 122 may be retracted to its outermost position. During this movement the engagement of the pawl cam surface 140 with shanks of the loaded nails causes the pawl lever 134 to move clear of the nail feed path 66. The nail stop lever projection 292 assures that nails are not ejected from the magazine assembly 50 during this cocking movement of the pusher assembly 122.

While the invention has been described with reference to details of the illustrated embodiment, such details are not intended to limit the scope of the invention as defined in the following claims.

What is claimed and desired to be secured by Letters Patent of the United States is:

1. A loading assembly for loading uncollated fasteners from an elongated chute holding a supply of fasteners into the end of an elongated magazine of a fastener driving tool, said assembly comprising:

a feed coupling adapted to be supported on an end of the magazine and defining a loading opening;

an exit coupling adapted to be supported on an end of the chute and defining an exit opening;

feed and exit stop members movably supported respectively on the feed and exit couplings;

means resiliently biasing said stop members to block the corresponding loading and exit openings;

said feed and exit couplings being relatively movable toward one another in the longitudinal direction to a mated position wherein said loading and exit openings are aligned;

abutments defined on the feed and exit couplings engagable respectively with the exit and feed stops in said mated position for moving said stops clear of the corresponding openings;

a projection extending longitudinally from said exit coupling and defining a ramp structure; and said feed coupling including guide structure received upon said ramp structure for guided and supported sliding movement of said feed coupling into said mated position.

2. The assembly of claim 1 wherein said projection is located adjacent the bottom of said exit opening and said guide structure is located adjacent the bottom of said feed coupling.

3. The assembly of claim 2, wherein said guide structure is engagable with said ramp structure by moving said feed coupling transversely relative to said exit coupling.

4. The assembly of claim 3 wherein said ramp structure includes inclined guide surface means for aligning said guide structure and said ramp structure during said transverse movement.

5. The assembly of claim 1 wherein during separation of said feed and exit couplings, said feed coupling abutment disengages said exit stop member before said exit coupling abutment disengages said feed stop member.

6. For use with a fastener driving tool for driving uncollated fasteners, fastener loading and storing structure comprising: an elongated magazine adapted to be attached to the tool and including guide structure defining a feed path for holding a row of fasteners, an inclined loading chute including guide means defining a loading path for slidably supporting a supply of fasteners to be loaded into said magazine, a feed coupling supported on an end of said magazine and defining a fastener loading opening aligned with said feed path, a magazine stop member movably mounted on said feed coupling and resiliently biased to obstruct said feed path, an exit coupling supported on the lowermost end of said chute defining a fastener exit opening aligned with said loading path, a chute stop member movably mounted on said exit coupling and resiliently biased to obstruct said loading path, a projection extending from said exit coupling adjacent the bottom of said exit opening defining a ramp structure, said feed coupling including cooperating guide structure slidable upon said projection ramp structure for guiding said feed coupling toward a mated position in engagement with said exit coupling wherein said feed path is aligned with said loading path and said loading and exit openings are adjacent one another, an abutment on said feed coupling engagable with said chute stop member for moving the chute stop member out of said loading path, and an abutment on said exit coupling engagable with said magazine stop member for moving the magazine stop member out of the loading path, said abutments and said stop members being located so that as the feed coupling moves away from the exit coupling, the chute stop member enters the loading path before the magazine stop member enters the feed path.

* * * * *